US007497432B2

(12) United States Patent
Ikeda

(10) Patent No.: US 7,497,432 B2
(45) Date of Patent: Mar. 3, 2009

(54) SHEET SUPPLYING DEVICE

(75) Inventor: Akihiro Ikeda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 229 days.

(21) Appl. No.: 11/078,386

(22) Filed: Mar. 14, 2005

(65) Prior Publication Data

US 2005/0200071 A1 Sep. 15, 2005

(30) Foreign Application Priority Data

Mar. 15, 2004 (JP) ..... 2004-072724

(51) Int. Cl.
*B65H 3/52* (2006.01)

(52) U.S. Cl. ..... 271/121; 271/167

(58) Field of Classification Search ..... 271/121, 271/122, 167

See application file for complete search history.

(56) References Cited

U.S. PATENT DOCUMENTS

| | | | | |
|---|---|---|---|---|
| 5,573,338 | A * | 11/1996 | Morikawa et al. | 400/611 |
| 5,727,782 | A | 3/1998 | Okada | |
| 7,128,316 | B2 * | 10/2006 | Nakano et al. | 271/121 |
| 2003/0062668 | A1 | 4/2003 | Shibata et al. | |

FOREIGN PATENT DOCUMENTS

| | | | |
|---|---|---|---|
| EP | 0 903 310 | A2 | 3/1999 |
| EP | 0 903 310 | A3 | 12/1999 |
| GB | 1 592 241 | | 7/1998 |
| JP | 63-272728 | | 11/1988 |
| JP | 02-056333 | | 2/1990 |
| JP | 02-261734 | | 10/1990 |
| JP | 3-288735 | A | 12/1991 |
| JP | 04-066436 | | 3/1992 |
| JP | 05-186081 | | 7/1993 |
| JP | 6-321375 | A | 11/1994 |
| JP | 9-124175 | A | 5/1997 |
| JP | 09-278210 | | 10/1997 |
| JP | 2002-137838 | | 5/2002 |

OTHER PUBLICATIONS

European Search Report for Application No. 05 25 1515, completed Jun. 24, 2005.

Notification of Reasons of Rejection dated Sep. 4, 2007 in Japanese Application No. 2004-72724 and English Translation thereof.

* cited by examiner

*Primary Examiner*—Kaitlin S Joerger
(74) *Attorney, Agent, or Firm*—Banner & Witcoff, Ltd

(57) ABSTRACT

A sheet supplying device is provided with a separation roller having an outer circumferential surface contacting at least a part of the sheets in a stacked state, and a pad located to face the outer circumferential surface of the separation roller. The sheet supplying device is further provided with a holder that holds the pad and is movable relative to the separation roller, and a pressing mechanism that presses the holder in a direction in which the pad held by the holder approaches the separation roller. The pad contacts a first surface of a sheet being fed by rotation of the separation roller, and the first surface of the sheet is opposite to a second surface of the sheet contacting the outer circumferential surface of the separation roller. The holder has a recessed portion formed on an upstream side of a pressurization point at which the sheet being fed is nipped between the separation roller and the pad. Space is formed by the recessed portion and a surface of the pad facing the holder.

21 Claims, 9 Drawing Sheets

SHEET SUPPLYING DEVICE

INCORPORATION BY REFERENCE

This application claims priority to Japanese Patent Application No. 2004-072724, filed on Mar. 15, 2004, the entire subject matter of the application is incorporated herein by reference thereto.

BACKGROUND OF THE INVENTION

1. Technical Field

Aspects of the present invention relate to a sheet supplying device used for various types of image forming devices such as a facsimile device, a printer and a copying device.

2. Description of Related Art

Sheet supplying devices are widely used in various types of image forming devices. FIGS. 9A and 9B show a facsimile device 80 employing a conventional sheet supplying device. FIG. 9A is a side view of the sheet supplying device of the facsimile device 80, and FIG. 9B is an enlarged view of a circled portion D of the sheet supplying device shown in FIG. 9A. The facsimile device 80 is configured such that a plurality of sheets 84 stacked on a sheet tray 82 are supplied one by one to the inside of the facsimile device 80 by rotation (in counterclockwise direction in FIG. 9A) of a separation roller 86.

The sheets 84 are placed on the sheet tray 82 in a slanting position with the front edges thereof contacting with contact surfaces 88. A separation pad 90 is located at a lower left position of the separation roller 86 on FIG. 9A. The separation pad is attached to a holder 92. The holder 92 is configured to be capable of pivoting around its right side position so that the separation pad 90 closely contacts the separation roller 86 by a pressing force caused by a coil spring 94. The sheets 84 are separated one by one when being sandwiched between the separation roller 86 and the separation pad 90.

The contact surfaces 88 are located at a plurality of positions, along a sheet width direction, including both side positions of the separation roller 86 and both end positions of the sheet tray 82. Each contact surface 88 is a surface of a small rib-like member. When a sheet from sheet 84 is carried to a printing head 96, ink is transferred from an ink ribbon 98 to the sheet 84 to form an image on the sheet from sheet 84.

Japanese Patent Provisional Publication No. 2002-137838 discloses a conventional sheet supplying device employing a separation pad for removing sheets one by one.

As shown in FIG. 9B, in the conventional facsimile device 80, the contact surface 88 is inclined with respect to a mounting surface (which is usually a horizontal surface) by an angle β. Therefore, it is required to press the sheets 84 in a direction E by use of a pressing plate 89 for supplying the sheets toward the inside of the facsimile device 80.

FIGS. 10A to 10D show another type of a contact surface configured to eliminate the need for using the pressing plate 89. If the separation roller 86 starts to rotate (see FIG. 10A), a plurality of sheets are carried to the separation pad 90 (see FIG. 10B), and the plurality of sheets slide and are sandwiched between the separation roller 86 and the separation pad 90, so that the plurality of sheets press the separation pad 90 downward (see FIG. 10C). Consequently, a gap is formed between the separation roller 86 and the separation pad 90, by which a separating operation of the sheet supplying device is performed and a phenomenon that a plurality of sheets are carried into the inside of the facsimile device simultaneously may be occur (see FIG. 10D).

SUMMARY OF THE INVENTION

Aspects of the present invention are advantageous in that they provide a sheet supplying device configured to avoid the above mentioned phenomenon that a plurality of sheets are carried into the inside of a image forming device simultaneously.

BRIEF DESCRIPTION OF THE ACCOMPANYING DRAWINGS

DETAILED DESCRIPTION OF THE EMBODIMENTS

Figure 1:
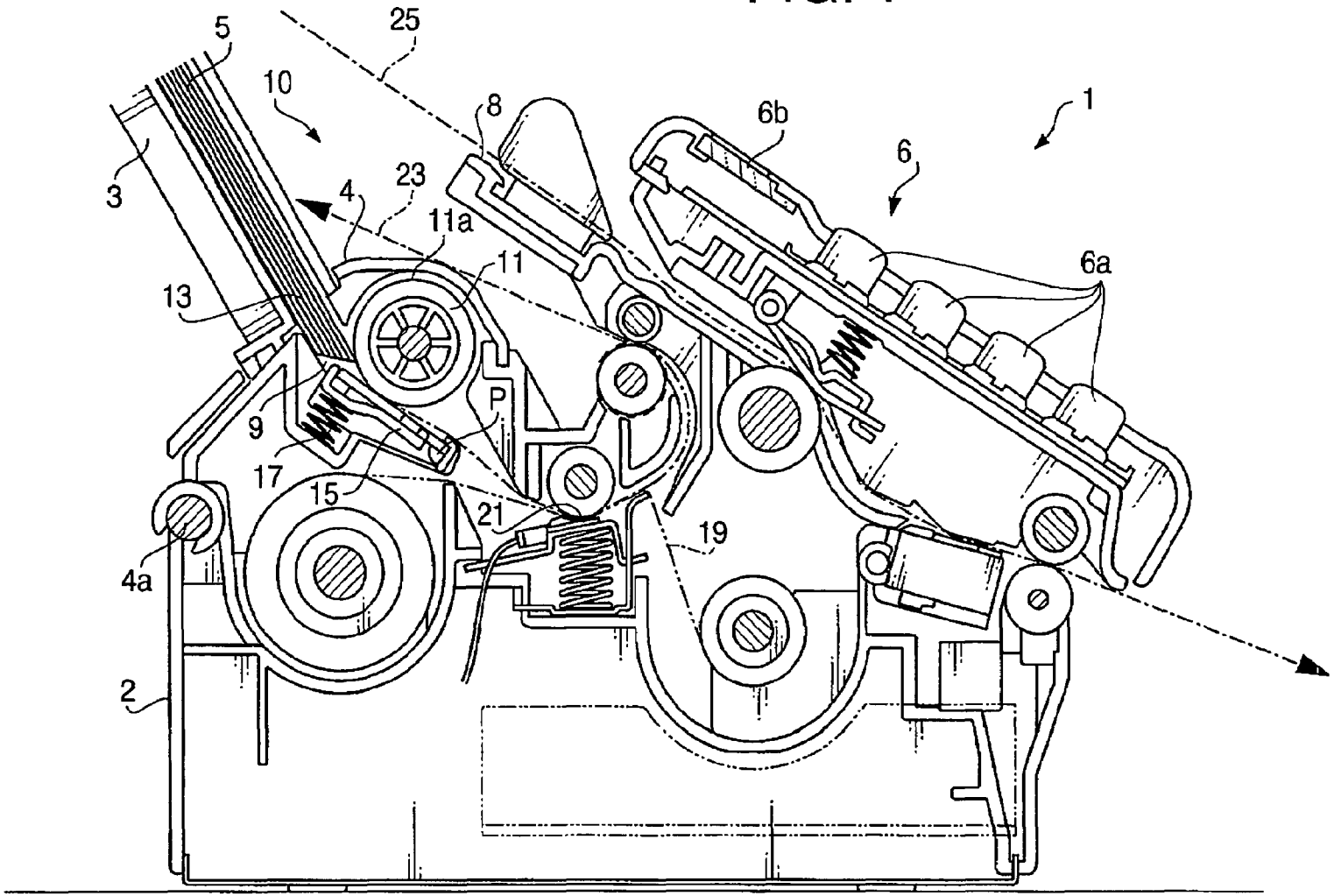
FIG. 1 is a cross-sectional side view of a facsimile device, to which the present invention is applied, illustrating an inside structure of the facsimile device.

General Overview of Aspects of the Invention

According to an aspect of the invention, there is provided a sheet supplying device for supplying sheets one by one. The sheet supplying device is provided with a separation roller having an outer circumferential surface contacting at least a part of the sheets in a stacked state, and a pad located to face the outer circumferential surface of the separation roller. The sheet supplying device is further provided with a holder that holds the pad and is movable relative to the separation roller, and a pressing mechanism that presses the holder in a direction in which the pad hold by the holder approaches the separation roller. The pad contacts a first surface of a sheet being fed by rotation of the separation roller, and the first surface of the sheet is opposite to a second surface of the sheet contacting the outer circumferential surface of the separation roller. The holder has a recessed portion formed on an upstream side of a pressurization point at which the sheet being fed is nipped between the separation roller and the pad. Space may be formed between the recessed portion and a surface of the pad facing the holder.

With this configuration, a part of the pad above the recessed portion is bent toward the recessed portion of the holder when the pad is pressed by the sheets. Therefore, even if a plurality of sheets enter into space between the pad and the separation roller, the sheets are stopped by a recessed part of the pad. As a result, a sheet situated at the top of the sheets that entered into the space is carried by the separation roller. Thus, the above mentioned phenomenon that a plurality of sheets are carried into the inside of a image forming device simultaneously is prevented.

Optionally, the holder may have a holding portion that holds the pad and is located on a downstream side with respect to the pressurization point.

In one example, the holding portion may include a projection, and the pad may have a through hole into which the projection of the holding portion fits.

Optionally, the projection may have a hook portion that catches the pad in a condition in which the projection of the holder is fitted into the through hole of the pad.

In one example, the holding portion may include a hook that catches an edge portion of the pad.

In another example, a part of the pad may be adhered to the holder by use of an adhesive.

Optionally, the sheet supplying device may include a sheet-like member adhered to the surface of the pad facing the holder so that a portion of the surface of the pad facing the recessed portion of the holder is not covered with the sheet-like member.

Still optionally, the holder may include a contact part located on an upstream side of the recessed portion, the contact part of the holder contacting a part of the surface of the pad facing the holder to support the pad.

Still optionally, the holder may be configured to be rotatable about a rotational axis situated on a downstream side of the pressurization point so that the holder is rotated to move near to or to move away from the separation roller.

Still optionally, the sheet supplying device may include a sheet tray on which the sheets in the stacked state are set, and a contact wall having a contact surface with which a front edge of the sheets in the stacked state comes in contact. The contact surface is inclined so that a downstream side of the contact surface is lower than an upstream side of the contact surface.

Still optionally, a surface of the pad facing the sheet being carried is inclined so that a downstream side of the surface of the pad facing the sheet is lower than an upstream side of the surface of the pad facing the sheet. An angle of inclination of the contact surface of the contact wall with respect to a mounting surface of the sheet supplying device is smaller than an angle of inclination of the surface of the pad facing the sheet.

Still optionally, the contact wall may be located apart from the separation roller in a sheet width direction.

Still optionally, a downstream side edge of the contact surface may protrude toward a center axis of the separation roller with respect to the outer circumferential surface of the separation roller when viewed along the center axis of the separation roller.

In one example, the pad may be a plate-like member.

In another example, the pad may have a rectangular form when viewed as a plan view.

In a third example, the pad may be made of silicon rubber.

In a fourth example, the pad may have a width substantially the same as a width of the separation roller in a sheet width direction.

According to another aspect of the invention, there is provided an image forming device, which is provided with a sheet supplying unit that supplies sheets one by one toward a sheet feed path, and an image forming unit that forms an image on a sheet supplied by the sheet supplying unit. The sheet supplying unit includes a separation roller having an outer circumferential surface contacting at least a part of the sheets in a stacked state, and a pad located to face the outer circumferential surface of the separation roller. The ink supplying unit further includes a holder that holds the pad and is movable relative to the separation roller, and a pressing mechanism that presses the holder in a direction in which the pad held by the holder approaches the separation roller. The pad contacts a first surface of a sheet being carried by rotation of the separation roller, and the first surface of the sheet is opposite to a second surface of the sheet contacting the outer circumferential surface of the separation roller. The holder may include a recessed portion formed on an upstream side of a pressurization point at which the sheet being fed is nipped between the separation roller and the pad. Space is formed by the recessed portion and a surface of the pad facing the holder.

With this configuration, a part of the pad above the recessed portion is bent toward the recessed portion of the holder when the pad is pressed by the sheets. Therefore, even if a plurality of sheets enter into space between the pad and the separation roller, the sheets are stopped by a recessed part of the pad. As a result, a sheet situated at the top of the sheets that entered into the space is carried by the separation roller. Thus, the above mentioned phenomenon that a plurality of sheets are carried into the inside of an image forming device simultaneously is reduced in occurrence or prevented.

According to another aspect of the invention there is provided a sheet supplying device for supplying sheets, which is provided with a separation roller that contacts a first surface of at least one of said sheets, a pad located to face said separation roller, said pad contacting a second surface of said at least one of said sheets, a holder that holds said pad, and a pressing mechanism that presses said holder to force said pad to approach said separation roller. The holder has a recessed portion, with a space is formed between said recessed portion and said pad.

With this configuration, a part of the pad above the recessed portion is bent toward the recessed portion of the holder when the pad is pressed by the sheets. Therefore, even if a plurality of sheets enter into space between the pad and the separation roller, the sheets are stopped by a recessed part of the pad. As a result, a sheet situated at the top of the sheets that entered into the space is carried by the separation roller. Thus, the above mentioned phenomenon that a plurality of sheets are carried into the inside of a image forming device simultaneously is prevented.

Optionally, the sheet supplying device may include an attaching system that securely attaches said pad to said holder.

Embodiments of the Present Invention

Hereafter, an embodiment according to the invention will be described with reference to the accompanying drawings.

FIG. 1 is a cross-sectional side view of a facsimile device 1, to which the present invention is applied, illustrating an inside structure of the facsimile device 1. In the facsimile device 1, a sheet supplying device 10 is formed (see FIGS. 5A and 5B). The facsimile device 1 has a body case 2 and an upper cover 4 covering the body case 2 on the top side of the body case 2. The upper cover 4 is attached to the body case 2 to be rotatable upwardly and downwardly about a rotational shaft 4*a* provided at a rear side of the body case 2.

An operation panel 6 including key switches 6*a* and an LCD (liquid crystal display) panel 6*b* is provided at a front upper side of the upper cover 4. A sheet supply stand 3 is provided on an upper rear side of the facsimile device 1 so as to be rotatable about a point at the rear side position of the upper cover 4. In the sheet supply stand 3, sheets 5 in a stacked state are set in a slanting position. At a central position in the back and forth direction of the facsimile device 1, an original stand 8 is provided.

The sheets 5 are supplied to the inside of the facsimile device 1 one by one, by rotation of a separation roller 11 which may or may not be formed of rubber. The sheets 5 placed in the sheet supply stand 3 contact a contact wall 9 formed as a part of the sheet supply stand 3, and a part of the sheets 5 placed in the sheet supply stand 3 contacts an outer circumferential surface 11*a* of the separation roller 11, so that the sheets 5 are kept in a slating position in the sheet supply stand 3.

At a lower left position of the separation roller 11 on FIG. 1, a separation pad 13 (which may be or may not be formed of elastic material such as silicon rubber) is located. The separation pad 13 is attached to a holder 15. The holder 15 is mounted in the facsimile device 1 so as to be rotatable about a rotational axis P situated at a downstream side position thereof. The holder 15 is pressed toward the separation roller 11 so that the separation pad 13 closely contacts with the separation roller 13.

The sheet 5 separated by the separation roller 13 is then carried to a position of a printing head 21 so that ink is transferred to the sheet 5 from an ink ribbon 19 to form an image on the sheet 5. Thus, a printing unit including the printing head 21 and a platen roller is formed in the facsimile device 1. Then, the sheet 5 is turned upward as indicated by an arrow 23 of FIG. 1 and is ejected form the facsimile device 1. In FIG. 1, an arrow 25 indicates a carrying path of an original.

Figure 2A:
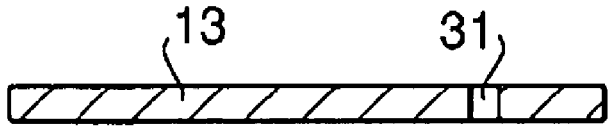
FIG. 2A is a cross-sectional side view of a separation pad in accordance with aspects of the present invention.
Figure 2B:
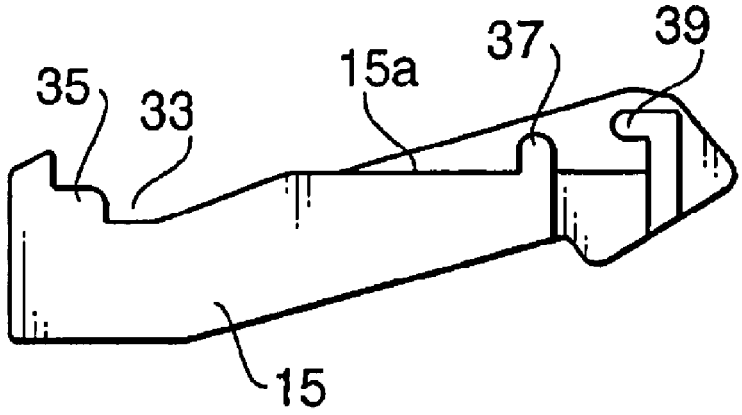
FIG. 2B is a cross-sectional side view of a holder in accordance with aspects of the present invention.
Figure 3A:
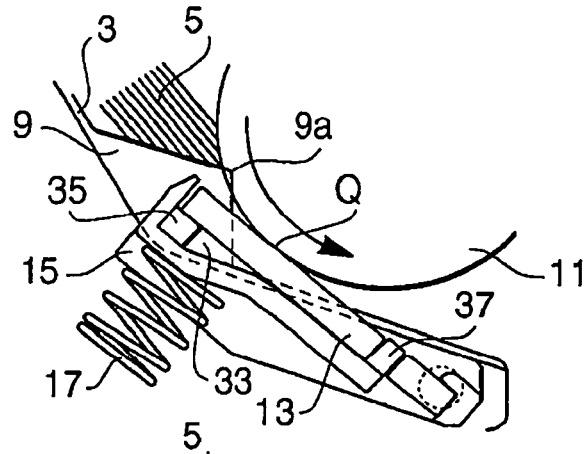
FIG. 3A shows a situation in which sheets is supplied to the inside of the facsimiled device by an operation of a sheet supplying device in accordance with aspects of the present invention.
Figure 3B:
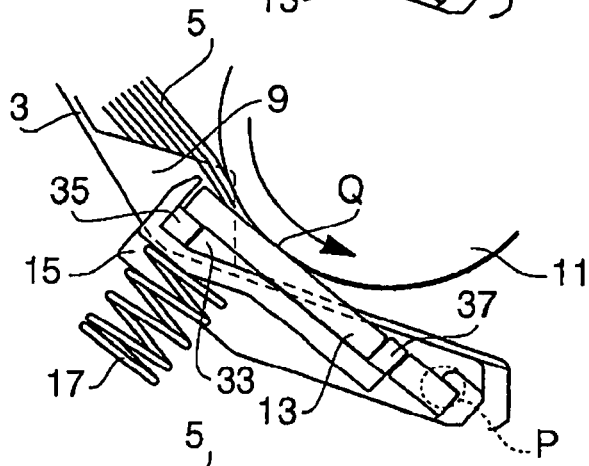
FIG. 3B shows a situation in which sheets is supplied to the inside of the facsimiled device by an operation of the sheet supplying device in accordance with aspects of the present invention.
Figure 3C:
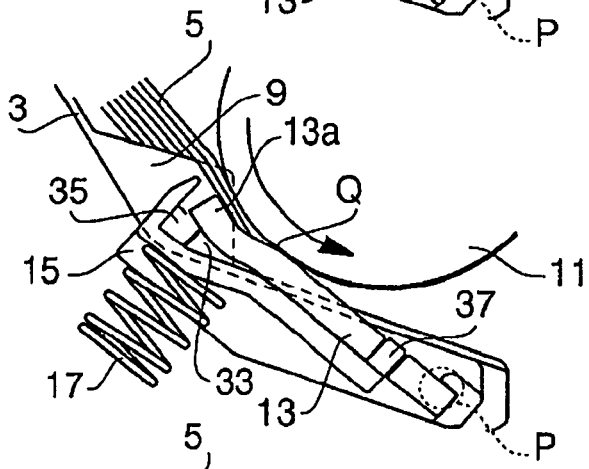
FIG. 3C shows a situation in which sheets is supplied to the inside of the facsimiled device by an operation of the sheet supplying device in accordance with aspects of the present invention.
Figure 3D:
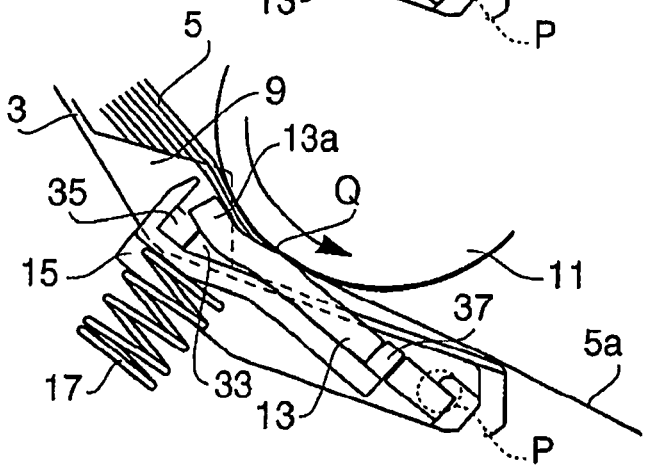
FIG. 3D shows the situation in which sheets is supplied to the inside of the facsimiled device by an operation of the sheet supplying device in accordance with aspects of the present invention.

FIG. 2A is a cross-sectional side view of the separation pad 13, and FIG. 2B is a cross-sectional side view of the holder 15. As shown in FIG. 2A, the separation pad 13 is a plate-like member having a through hole 31 at an inward position from the right end thereof. In a plan view, the separation pad 13 has a rectangular form, and the through hole 13 may or may not have an elliptic form elongate in a sheet width direction.

The holder 15 has a mounting surface 15*a* on which the separation pad 13 is placed. A projection 37 is formed to protrude upwardly from the mounting surface 15*a*. The projection 37 may be elongated in the sheet width direction. A position of the projection 37 is consistent with a position of the through hole 31 of the separation pad 13.

As shown in FIG. 2B, a height of the top surface of the holder 15 becomes lower as a distance from the mounting surface 15*a* increases so that a recessed portion 33 is formed on the left side of the top surface of the holder 15. Further, a contact part 35 is formed at the left end position on the top surface of the holder 15. The contact part 35 has the same height as that of the mounting surface 15*a*. On the right side of the mounting surface 15*a*, a hook portion 39 is formed.

The separation pad 13 may be attached to the holder 15 as follows. This is but one example of attachment. Firstly, the right edge portion of the separation pad 13 is inserted into the hook portion 39 so that the projection 37 is fitted into the through hole 31. Then, the left end portion of the separation pad 13 is placed on the contact part 35. By this structure, the separation pad 13 is held on the top surface of the holder 15 in a steady condition. Even if the stiffness of the separation pad is relatively low, the function and of the separation pad 13 for removing and carrying the sheet is maintained because the separation pad 13 is supported by the contact part 35 and held by the projection 37 and the hook portion 39. It is also possible to employ a material of the separation pad 13 having lower stiffness to further enhance the effect of preventing the phenomenon that a plurality of sheets are carried into the inside of a image forming device simultaneously.

In addition, the right edge portion of the separation pad 13 may be held by the hook portion 39 so as not to be detached upwardly from the hook portion 13. The movement of the separation pad 13 in the back and forth direction (left and right direction in FIG. 2A) may be restricted by the projection 37.

Accordingly, even if the separation pad 13 is pulled rightward in FIG. 2A in the situation in which the separation pad 13 is attached to the holder 15, the separation pad 13 is not removed from the holder 15 since the projection 37 restricts the movement of the separation pad. On the other hand, if the separation pad 13 is pulled leftward in FIG. 2 in the situation in which the separation pad 13 is attached to the holder 15, a right side part of the separation pad 13 with respect to the through hole 37 may be forced to be curled up in an upwards direction. However, in this illustrative embodiment, the upward movement of the right side part of the separation pad 13 is restricted by the hook portion 39. Therefore, the separation pad 13 is not removed from the holder 15. In the situation in which the separation pad 13 is attached to the holder 15, space is formed by the bottom surface of the separation pad 13 and the recessed portion 33.

FIGS. 3A to 3D show a situation in which the sheet 5 is supplied to the inside of the facsimiled device 1 by an operation of the sheet supplying device 10. In a condition in which the sheets 5 are placed in the sheet supply stand 3, the sheets 5 lie between the contact wall 9 and the separation roller 11 in an orderly manner under their own weight (see FIG. 3A). If the separation roller 11 starts to rotate in the condition of FIG. 3A, a plurality of sheets 5 are pulled by the rotation of the separation roller 11 simultaneously, and hit the separation pad 13 (see FIG. 3B).

That is, the plurality of sheets 5 enter into the upstream side space between the separation roller 11 and the separation pad 13. At this stage, a part of the separation pad 13 above the recessed portion 33 is bent toward the recessed portion 33, so that the plurality of the sheets 5 are stopped by the separation pad 13 without causing the holder 15 to rotate downwardly about the rotational axis P (see FIG. 3C). As a result, a sheet situated at the top of the sheets that entered into the upstream side space is carried by the separation roller 11. The plurality of sheets 5 stopped by the separation pad 13 are removed one by one to be supplied into the inside of the facsimile device 1 (see FIG. 3D). Thus, the occurrence of the phenomenon that a plurality of sheets are carried into the inside of the facsimile device 1 simultaneously may be prevented.

Figure 4B:
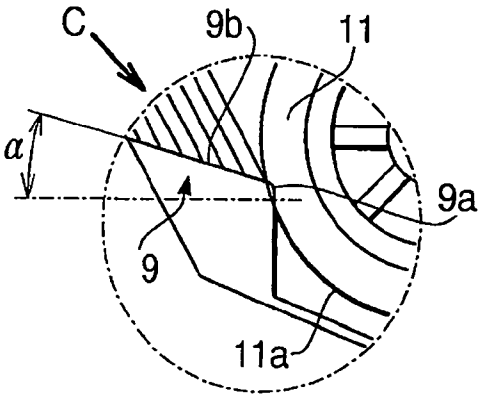
FIG. 4B is an enlarged view of a circled portion in FIG. 4A in accordance with aspects of the present invention.
Figure 4A:
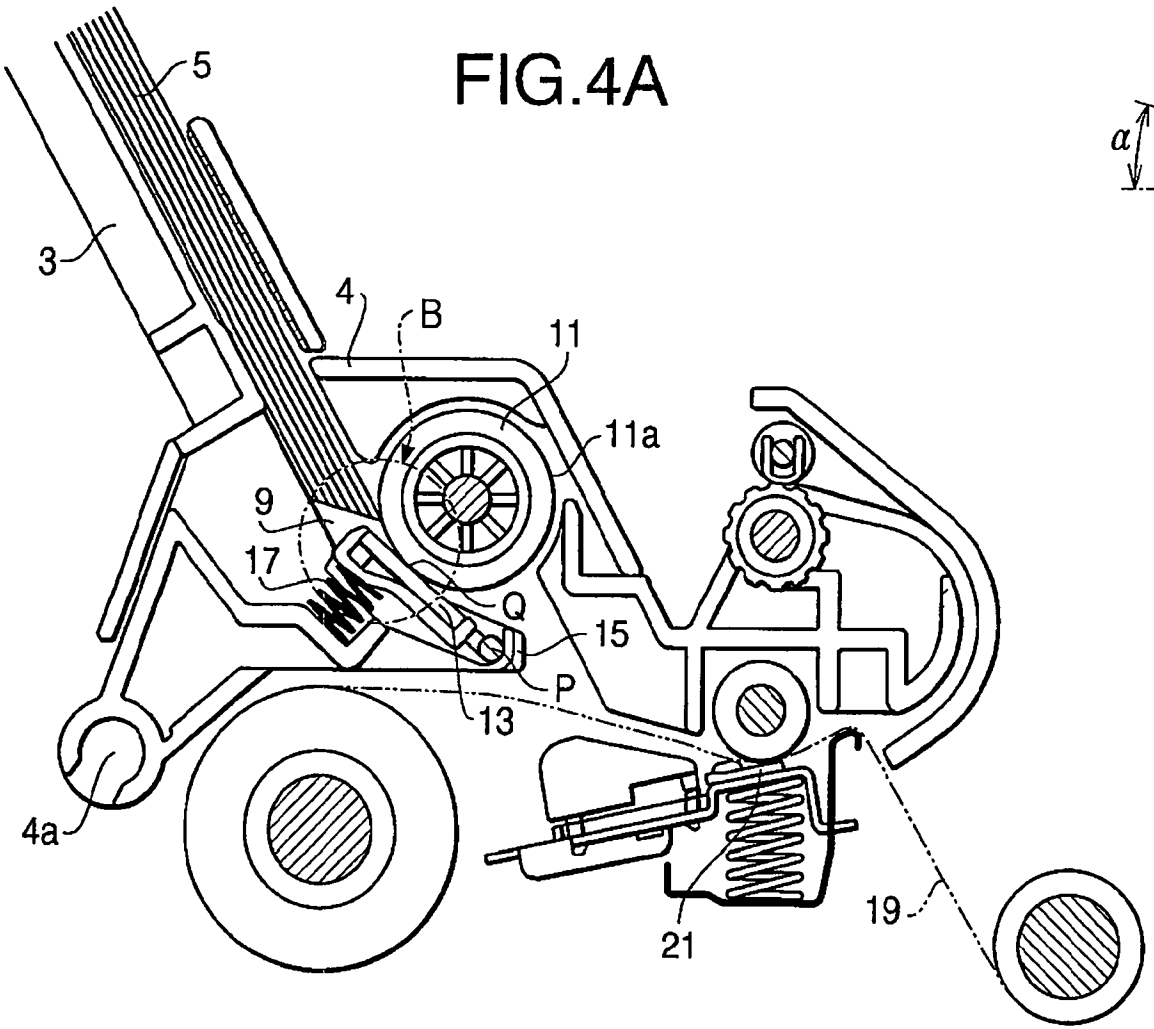
FIG. 4A is a side view of the facsimile device illustrating an upper part of the facsimiled device in accordance with aspects of the present invention.

FIG. 4A is a side view of the facsimile device 1 illustrating an upper part of the facsimiled device 1. FIG. 4B is an enlarged view of a circled portion in FIG. 4A. As indicated in detail in FIG. 4B, the contact wall 9 has a contact surface 9*b* with which the sheets 5 placed in the ink supplying base 3 come into contact. The contact surface 9*b* is inclined with respect to the mounting surface (e.g. a horizontal surface) of the facsimile device 1 by an angle $\alpha$ so that the downstream side part of the contact surface 9*b* is lower than the upstream side part of the contact surface 9*b*.

Figure 9B:
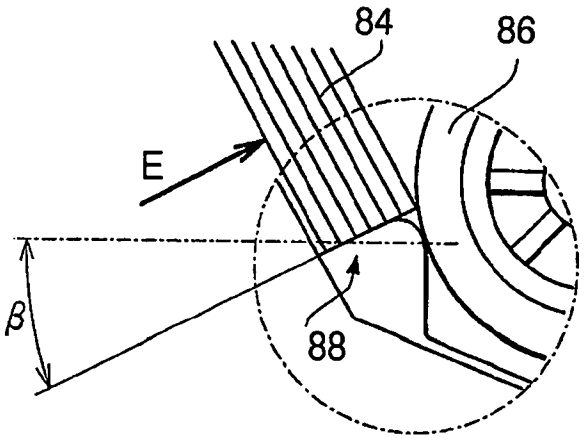
FIG. 9B is an enlarged view of a circled portion of the sheet supplying device shown in FIG. 9A.
Figure 9A:
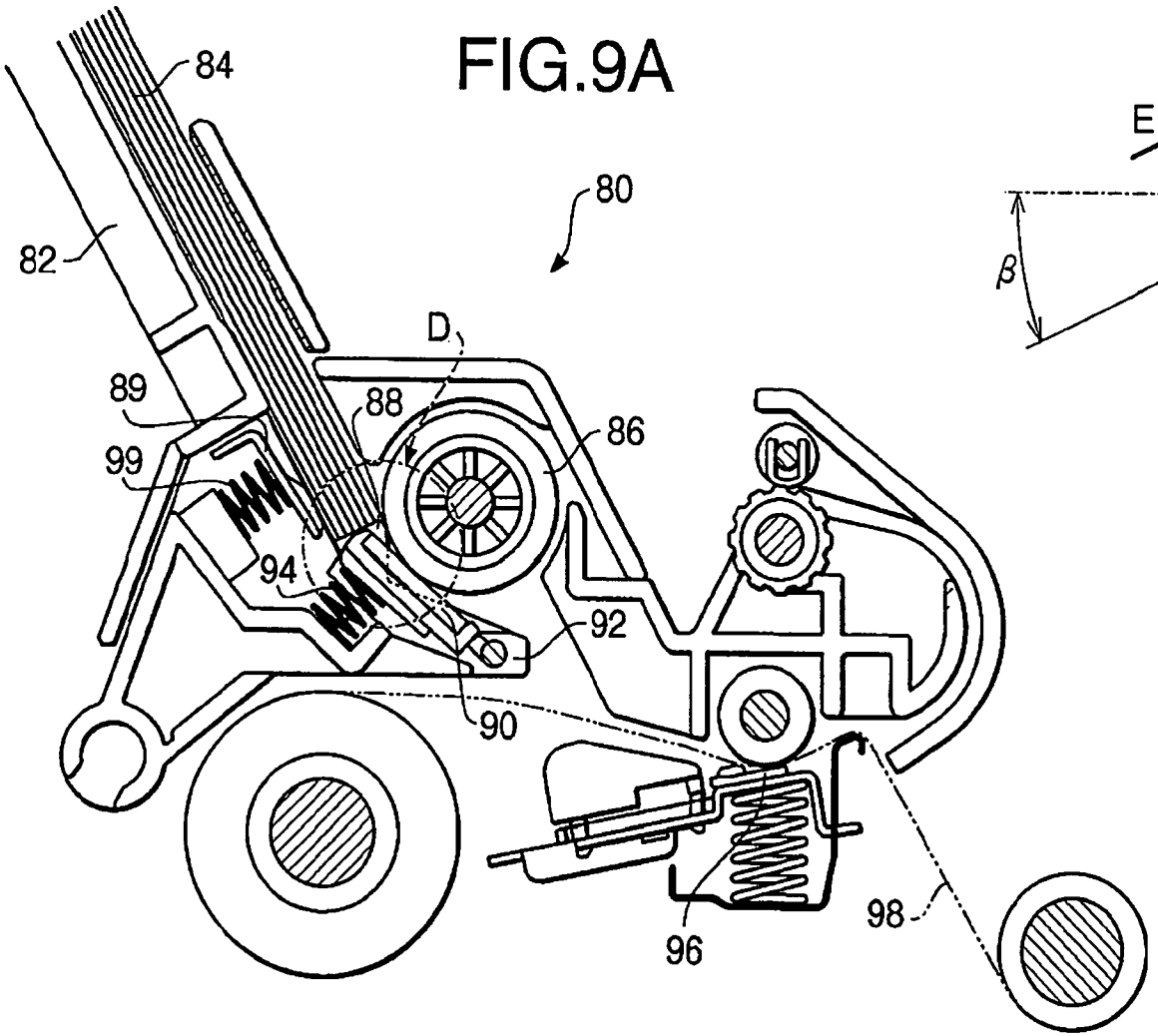
FIG. 9A is a side view of a conventional sheet supplying device.
Figure 10A:
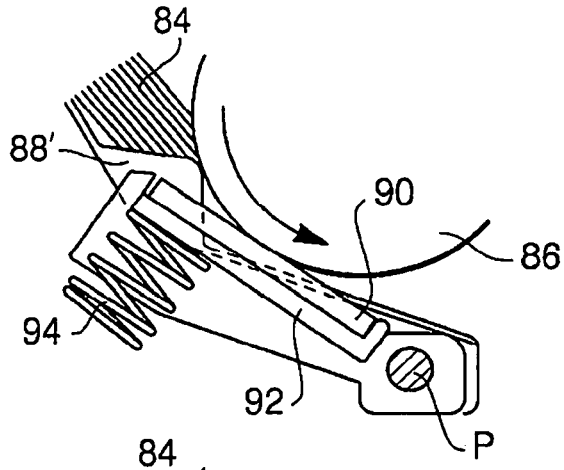
FIG. 10A shows operation of a sheet supplying device having a contact surface configured to eliminate the need for using a pressing plate.
Figure 10B:
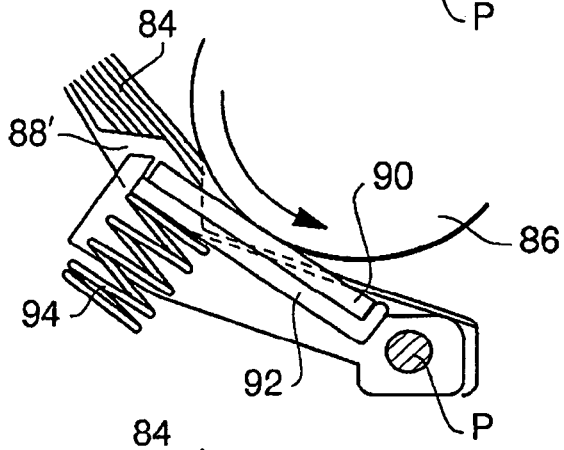
FIG. 10B shows the operation of a sheet supplying device having a contact surface configured to eliminate the need for using a pressing plate.
Figure 10C:
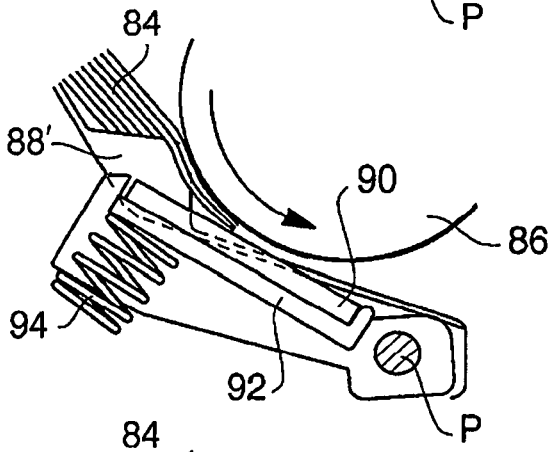
FIG. 10C shows the operation of a sheet supplying device having a contact surface configured to eliminate the need for using a pressing plate.
Figure 10D:
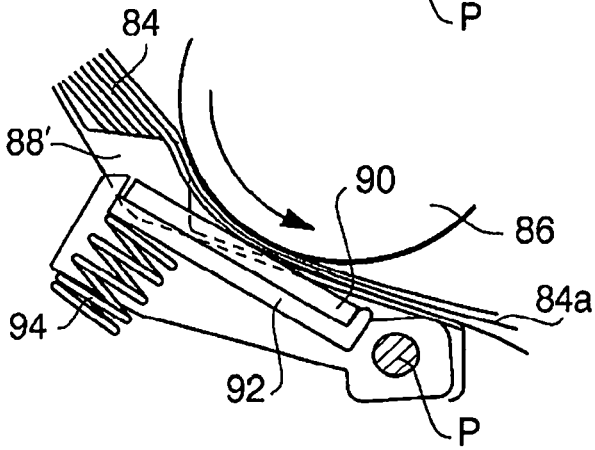
FIG. 10D shows the operation of a sheet supplying device having a contact surface configured to eliminate the need for using a pressing plate.

By this structure, the sheets 5 contact with the contact wall 9 under their own weight, which eliminates the necessity for the facsimile device 1 to include a pressing mechanism, for example, the pressing plate 89 and the coil spring 99 (see FIG. 9A) provided in the conventional sheet supplying device.

A top surface of the separation pad 13 facing the sheet 5 being carried is also inclined with respect to the mounting surface of the facsimile device 1 so that the downstream side of the top surface of the separation pad 13 is lower than the upstream side of the top surface of the separation pad 13. The angle of inclination ($\alpha$) of the contact surface 9*b* is smaller than the angle of inclination of the top surface of the separation pad 13. By this structure, the sheets 5 supplied by the separation roller 11 from the contact wall 9 are reliably pressed against the separation pad 13. Therefore, the advantage, that the occurrence of the phenomenon where the plurality of sheets are carried into the inside of the facsimile device simultaneously is prevented, is reliably attained.

In the side view of the contact wall 9 and the separation roller 11 shown in FIG. 4B, an edge portion 9*a* of the contact wall 9 is situated at a position slightly nearer to the center of the separation roller 11 than an outer circumferential surface 11*a* of the separation roller 11. However, as described below with reference to FIGS. 5A and 5B, the separation wall 9 is located aside the separation roller 11. Therefore, the contact wall 9 does not interfere with the separation roller 11. Also, even if the number of sheets 5 placed in the sheet supply stand 3 is large, the formation of a clearance between the edge portion 9*a* and the separation roller 11 is prevented, and thereby a part of the sheets 5 placed in the sheet supply stand 3 drops from the clearance between the edge portion 9*a* and the separation roller 11.

By this structure, the edge portion 9*a* serves as a pressing member for pressing the sheet 5 against the outer circumferential surface 11*a* of the separation roller 11. Therefore, an adequate force for carrying the sheet 5 acts on the sheet 5 by the separation roller 11.

Figure 5A:
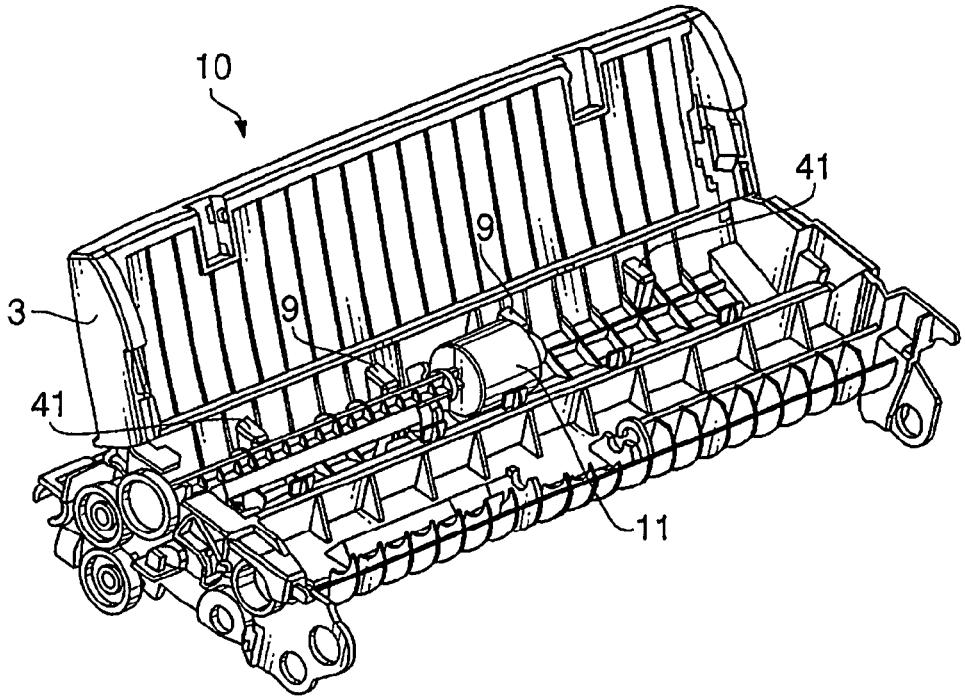
FIG. 5A is a perspective view of the sheet supplying device formed in the facsimile device in accordance with aspects of the present invention.
Figure 5B:
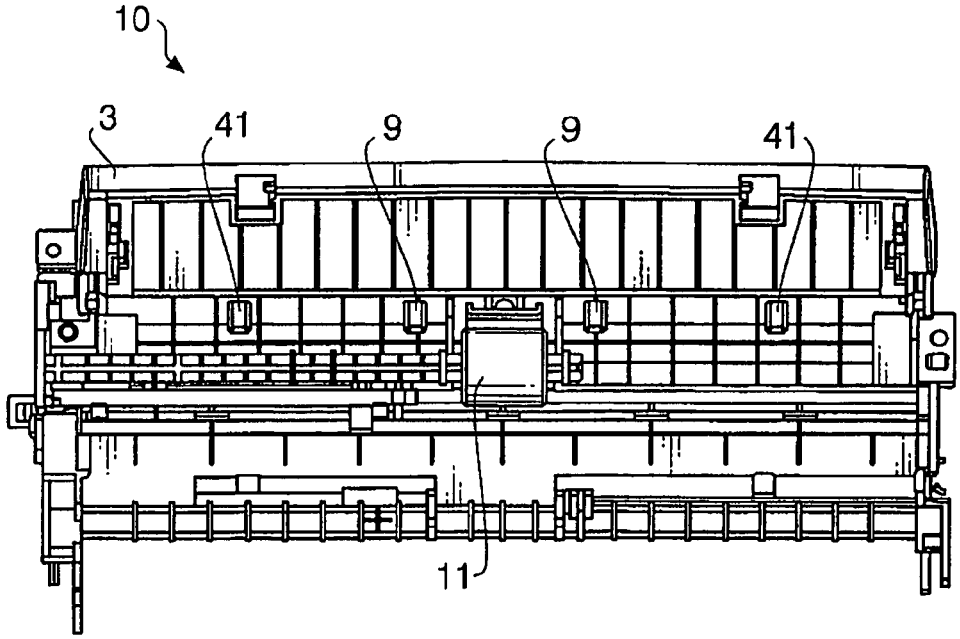
FIG. 5B is a plan view of the sheet supplying device in accordance with aspects of the present invention.

FIG. 5A is a perspective view of the sheet supplying device 10 formed in the facsimile device 1. FIG. 5B is a plan view of the sheet supplying device 10. The sheet supplying device 10 includes four contact walls (9, 9, 41 and 41). The contact wall 41 has the same structure as the contact wall 9. More specifically, the sheet supplying device 10 includes two contact walls 9 and 9 located aside the separation roller 11, and two separation walls 41 and 41 located in the vicinities of both of the end portions of the sheet supply stand 3 in the sheet width direction. Each of the contact walls 9, 9, 41 and 41 may be formed as a rib-like member. As shown in FIG. 5B, the separation pad 13 has a width substantially the same as a width of the separation roller 11 in the sheet width direction.

Since the end portion (left end portion in FIGS. 2A and 2B) of the separation pad 13 is supported by the contact part 35 of the holder 15, the separation pad 13 is not required to have a high degree of stiffness. That is, the separation pad 13 may be formed such that the separation pad 13 is bent toward the recessed portion 33 of the holder 15.

Since the downstream side part of the separation pad 13 is securely held on the holder 15 by the projection 37 and the hook portion 39, if a user forcibly pulls a sheet located at a point along a sheet feed path, the separation pad 13 is not curled up.

Since the rotational axis P (pivot) is situated at a downstream side with respect to a pressurization point Q at which the sheet being carried is held tight between the separation roller 11 and the separation pad 13 (see FIGS. 3A to 3D), the friction between the sheet 5 and the separation pad 13 acts as moment having a direction of pressing the separation pad 13 against the sheet 5. Therefore, the sheet 5 is pressed against the separation pad 13 (the separation roller 11) more strongly, by which the effect for preventing the occurrence of the phenomenon that the plurality of sheets are carried into the inside of the facsimile device simultaneously is enhanced.

Since the rotational axis P is situated at the downstream side of the pressurization point Q, the position at which the rotational axis is to be located is not restricted by the sheet tray, and thereby the distance between the rotational axis and the pressurization point can be increased in comparison with the case in which the rotational axis is situated at the upstream side of the pressurization point. Therefore, the separating operation for the sheets becomes stable. Such a structure can also contribute to downsizing of the sheet supplying device.

Although the present invention has been described in considerable detail with reference to certain preferred embodiments thereof, other embodiments are possible.

For example, although in the above mentioned embodiment the sheet supplying device is implemented as a facsimile device, the sheet supplying device may be implemented as another image forming device such as a copying device or a printer.

Figure 6:
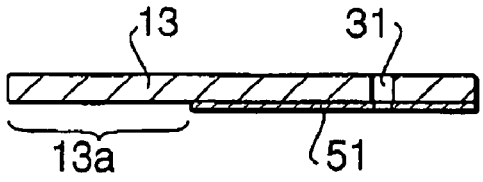
FIG. 6 is a cross-sectional side view of a separation pad having a sheet-like member in accordance with aspects of the present invention.

As shown in FIG. 6 which is a cross-sectional side view of the separation pad, a sheet-like member 51 may be adhered to the bottom surface (a surface facing the mounting surface 15*a* of the holder 15) so as to increase the stiffness of the separation pad 13 without changing a base material of the separation pad 13 to a different type (i.e. without changing a property of the separation pad, such as a friction coefficient or the manner that the separation pad is bent toward the recessed portion 33). One of examples of material of the sheet-like member 15 is PET (polyethylene terephthalate). By designing the shape of the sheet-like member 51 so that a part 13*a* of the bottom surface of the separation pad 13 facing the recessed portion 33 is not covered with the sheet-like member 51, the manner that the separation pad 13 is bent toward the recessed portion 33 is not affected.

Figure 7A:
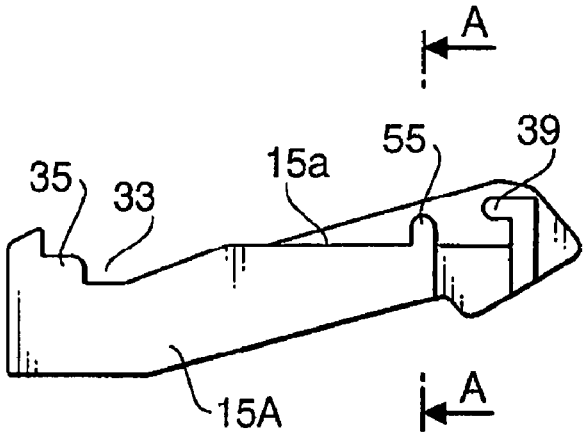
FIG. 7A is a side view of a variation of the holder in accordance with aspects of the present invention.
Figure 7B:
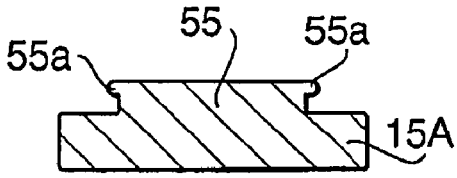
FIG. 7B is a cross-sectional view of the holder shown in FIG. 7A viewed from the front side in accordance with aspects of the present invention.

FIGS. 7A and 7B show a holder 15A as a variation of the holder 15. FIG. 7A is a side view of the holder 15A, and FIG. 7B is a cross-sectional view of the holder 15A along a line A-A in FIG. 7A viewed from the front side (right side in FIG. 7A). In FIGS. 7A and 7B, to elements which are similar to those shown in FIG. 2B, the same reference numbers are assigned, and the detailed description thereof will not be repeated. As shown in FIG. 7B, the holder 15A has a projection 55 elongated in the sheet width direction. The projection 55 has hook portions 55*a* and 55*a* at its both end portions in the sheet width direction.

Since the projection 55 has the hook portions 55*a* and 55*a*, after the projection 55 is completely fitted into the through hole 31 of the separation pad 13, the separation pad 13 is held by the holder 15 more securely. In addition, curling up of the separation pad 13 is prevented without forming the hook portion 39 at the right end of the holder 15.

In addition to or as an alternative to forming the hook portion 39 at the right end of the holder 15 or forming the hook portions 55*a* and 55*a* at both of the end portions of the projection 55 for preventing the curling up of the separation pad 13, the separation pad 13 may be adhered to the top surface of the holder 15 by use of an adhesive. In this case, curling up of the separation pad 13 is prevented.

Figure 8A:
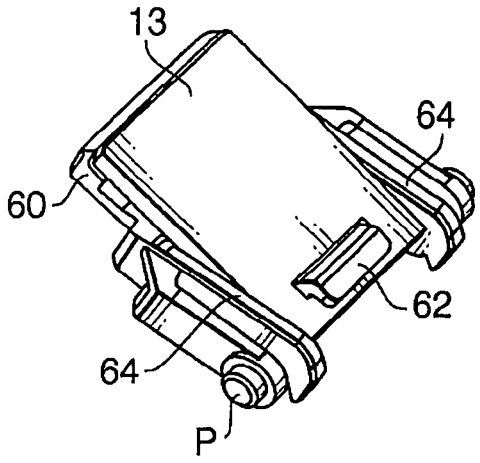
FIG. 8A is a perspective view of another variation of the holder shown in FIG. 2B in accordance with aspects of the present invention.
Figure 8B:
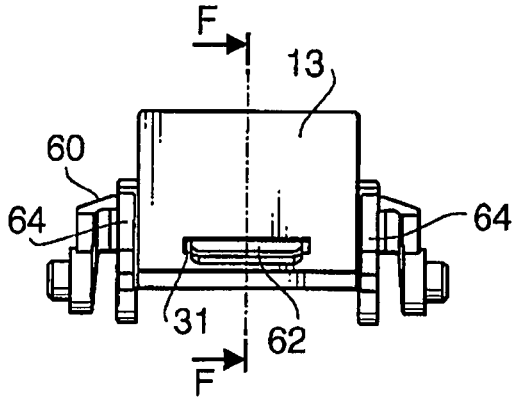
FIG. 8B is a front view of the holder shown in FIG. 8A in accordance with aspects of the present invention.
Figure 8C:
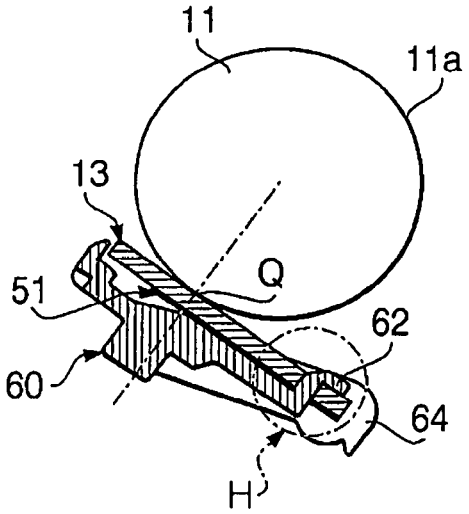
FIG. 8C is a cross-sectional side view of the holder along a line F-F in FIG. 8B in accordance with aspects of the present invention.
Figure 8D:
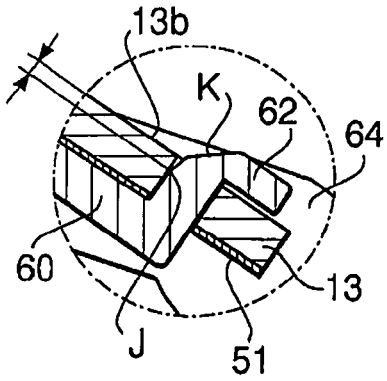
FIG. 8D is an enlarged view of a circled portion H in FIG. 8C in accordance with aspects of the present invention.

FIGS. 8A to 8D show another variation the holder 15. FIG. 8A is a perspective view of a holder 60 as the variation of the holder 15, FIG. 8B is a front view of the holder 60, FIG. 8C is a cross-sectional side view of the holder 60 along a line F-F in FIG. 8B, and FIG. 8D is an enlarged view of a circled portion H in FIG. 8C. In FIG. 8C, the separation roller 11 is also indicated. The holder 60 has a projection 62 at its downstream end position.

An upper side part of the projection 62 is bent toward the rotational axis P. Therefore, if the projection 62 is completely fitted into the through hole 31 of the separation pad 13, the curling up of the separation pad 13 is prevented.

As shown in FIG. 8D, an inclined surface K starts from a point J which is lower than the top surface 13*b* of the separation pad 13. By this structure, sheet 5 is prevented from hitting the projection 62 while the sheet 5 is carried by the rotation of the separation roller 11.

The holder 60 has ribs 64 at its both sides in the sheet width direction. As shown in FIG. 8D, each rib 64 has a height approximately equal to a height of the projection 62, by which it is prevented that both sides of the sheet 5 is curled downwardly due to upward force applied by the projection 62.

I claim:

1. A sheet supplying device for supplying sheets one by one, comprising:

a separation roller having an outer circumferential surface contacting at least a part of the sheets in a stacked state;

a pad located to face the outer circumferential surface of the separation roller;

a holder that holds the pad and is movable relative to the separation roller; and a pressing mechanism that presses the holder in a direction in which the pad held by the holder approaches the separation roller, wherein the pad contacts a first surface of a sheet being fed by rotation of the separation roller, and the first surface of the sheet is opposite to a second surface of the sheet contacting the outer circumferential surface of the separation roller, wherein the holder has a recessed portion formed on an upstream side of a pressurization point at which the sheet being fed is nipped between the separation roller and the pad, space being formed by the recessed portion and a surface of the pad facing the holder, wherein the holder has a holding portion that holds the pad and is located downstream with respect to the pressurization point, and wherein the holder is configured to be rotatable about a rotational axis situated on a downstream side of the pressurization point so that the holder is rotated to move near to or to move away from the separation roller.

2. A sheet supplying device for supplying sheets one by one, comprising:

a separation roller having an outer circumferential surface contacting at least a part of the sheets in a stacked state;

a pad located to face the outer circumferential surface of the separation roller;

a holder that holds the pad and is movable relative to the separation roller; and a pressing mechanism that presses the holder in a direction in which the pad held by the holder approaches the separation roller, wherein the pad contacts a first surface of a sheet being fed by rotation of the separation roller, and the first surface of the sheet is opposite to a second surface of the sheet contacting the outer circumferential surface of the separation roller, wherein the holder has a recessed portion formed on an upstream side of a pressurization point at which the sheet being fed is nipped between the separation roller and the pad, space being formed by the recessed portion and a surface of the pad facing the holder, wherein the holder has a holding portion that holds the pad and is located downstream with respect to the pressurization point, wherein the holding portion includes a projection, wherein the pad has a through hole into which the projection of the holding portion fits, and wherein the projection is located downstream with respect to the pressurization point.

3. The sheet supplying device according to claim 2, wherein the projection has a hook portion that catches the pad in a condition in which the projection of the holder is fitted into the through hole of the pad.

4. The sheet supplying device according to claim 1, wherein the holding portion includes a hook that catches an edge portion of the pad.

5. The sheet supplying device according to claim 1, wherein a part of the pad is adhered to the holder by use of an adhesive.

6. The sheet supplying device according to claim 1, further comprising a sheet-like member adhered to the surface of the pad facing the holder so that a portion of the surface of the pad facing the recessed portion of the holder is not covered with the sheet-like member.

7. The sheet supplying device according to claim 1, wherein the holder includes a contact part located on an upstream side of the recessed portion, the contact part of the holder contacting a part of the surface of the pad facing the holder to support the pad.

8. The sheet supplying device according to claim 1, further comprising:

a sheet tray on which the sheets in the stacked state are set; and a contact wall having a contact surface with which a front edge of the sheets in the stacked state comes in contact, wherein the contact surface is inclined so that a downstream side of the contact surface is lower than an upstream side of the contact surface.

9. The sheet supplying device according to claim 8, wherein a surface of the pad facing the sheet being carried is inclined so that a downstream side of the surface of the pad facing the sheet is lower than an upstream side of the surface of the pad facing the sheet, and wherein an angle of inclination of the contact surface of the contact wall with respect to a mounting surface of the sheet supplying device is smaller than an angle of inclination of the surface of the pad facing the sheet.

10. The sheet supplying device according to claim 8, wherein the contact wall is located apart from the separation roller in a sheet width direction.

11. The sheet supplying device according to claim 10, wherein a downstream side edge of the contact surface protrudes toward a center axis of the separation roller with respect to the outer circumferential surface of the separation roller when viewed along the center axis of the separation roller.

12. The sheet supplying device according to claim 1, wherein the pad is a plate-like member.

13. The sheet supplying device according to claim 1, wherein the pad has a rectangular form when viewed as a plan view.

14. The sheet supplying device according to claim 1, wherein the pad is made of silicon rubber.

15. The sheet supplying device according to claim 1, wherein the pad has a width substantially the same as a width of the separation roller in a sheet width direction.

16. An image forming device, comprising:

a sheet supplying unit that supplies sheets one by one toward a sheet feed path; and an image forming unit that forms an image on a sheet supplied by the sheet supplying unit, wherein the sheet supplying unit includes:

a separation roller having an outer circumferential surface contacting at least a part of the sheets in a stacked state;

a pad located to face the outer circumferential surface of the separation roller;

a holder that holds the pad and is movable relative to the separation roller; and a pressing mechanism that presses the holder in a direction in which the pad held by the holder approaches the separation roller, wherein the pad contacts a first surface of a sheet being fed by rotation of the separation roller, and the first surface of the sheet is opposite to a second surface of the sheet contacting the outer circumferential surface of the separation roller, wherein the holder has a recessed portion formed on an upstream side of a pressurization point at which the sheet being fed is nipped between the separation roller and the pad, space being formed by the recessed portion and a surface of the pad facing the holder, wherein the holder has a holding portion that holds the pad and is located downstream with respect to the pressurization point, and wherein the holder is configured to be rotatable about a rotational axis situated on a downstream side of the pressurization point so that the holder is rotated to move near to or to move away from the separation roller.

17. A sheet supplying device for supplying sheets comprising:

a separation roller that contacts a first surface of at least one of said sheets;

a pad located to face said separation roller, said pad contacting a second surface of said at least one of said sheets;

a holder that holds said pad;

a pressing mechanism that presses said holder to force said pad to approach said separation roller at a pressurization point; and an attaching system that securely attaches said pad to said holder, said attaching system located downstream of said pressurization point, wherein said holder has a recessed portion, with a space is formed between said recessed portion and said pad.

18. The image forming device according to claim 17, wherein the holder includes a contact part located on an upstream side of the recessed portion, the contact part of the holder contacting a part of the surface of the pad facing the holder to support the pad.

19. The sheet supplying device according to claim 18, wherein the holder includes a contact part located on an upstream side of the recessed portion, the contact part of the holder contacting a part of the surface of the pad facing the holder to support the pad.

20. A sheet supplying device for supplying sheets one by one, comprising:

a separation roller having an outer circumferential surface contacting at least a part of the sheets in a stacked state;

a pad located to face the outer circumferential surface of the separation roller;

a holder that holds the pad and is movable relative to the separation roller; and a pressing mechanism that presses the holder in a direction in which the pad held by the holder approaches the separation roller, wherein the pad contacts a first surface of a sheet being fed by rotation of the separation roller, and the first surface of the sheet is opposite to a second surface of the sheet contacting the outer circumferential surface of the separation roller, wherein the holder has a recessed portion formed on an upstream side of a pressurization point at which the sheet being fed is nipped between the separation roller and the pad, space being formed by the recessed portion and a surface of the pad facing the holder, wherein the holder has holding portion that holds the pad and is located downstream with respect to the pressurization point, and wherein an entire contacting part where the pad and the holder contact with each other is located downstream with respect to the pressurization point.

21. The sheet supplying device according to claim 1, wherein, in a direction in which a sheet is fed, a length of a part of the holder situated downstream with respect to the pressurization point is longer than a length of the other part of the holder situated upstream with respect to the pressurization point.

* * * * *

UNITED STATES PATENT AND TRADEMARK OFFICE

CERTIFICATE OF CORRECTION

PATENT NO. : 7,497,432 B2
APPLICATION NO. : 11/078386
DATED : March 3, 2009
INVENTOR(S) : Akihiro Ikeda It is certified that error appears in the above-identified patent and that said Letters Patent is hereby corrected as shown below:

On the Title page, References Cited Item (56), Foreign Patent Documents:
Please insert: --JP 60-2106 1/1985--

In Column 12, Claim 18, Line 17:
Please replace "claim 17" with --claim 16--

In Column 12, Claim 19, Line 22:
Please replace "claim 18" with --claim 17--

Signed and Sealed this

Twenty-fourth Day of November, 2009

David J. Kappos

David J. Kappos
*Director of the United States Patent and Trademark Office*